US005683545A

United States Patent [19]

Goodwin et al.

[11] Patent Number: 5,683,545

[45] Date of Patent: Nov. 4, 1997

[54] HAND-HELD LABELER

[75] Inventors: Brent E. Goodwin, Middletown; Thomas P. Keller, Centerville; James A. Makley, Springboro; Mark W. Moore, Miamisburg, all of Ohio

[73] Assignee: Monarch Marking Systems, Inc., Dayton, Ohio

[21] Appl. No.: 438,333

[22] Filed: May 10, 1995

Related U.S. Application Data

[62] Division of Ser. No. 177,887, Jan. 5, 1994, Pat. No. 5,486,259.

[51] Int. Cl.[6] ..... B65C 11/02

[52] U.S. Cl. ..... 156/577; 156/579; 156/384; 156/387; 235/470; 235/472

[58] Field of Search ..... 156/384, 387, 156/577, 584, 579; 235/472, 454, 470

[56] References Cited

U.S. PATENT DOCUMENTS

| | | |
|---|---|---|
| D. 308,865 | 6/1990 | Weaver et al. . |
| 4,191,608 | 3/1980 | Bussard et al. . |
| 4,199,392 | 4/1980 | Hamisch, Jr. . |
| 4,264,396 | 4/1981 | Stewart . |
| 4,544,434 | 10/1985 | Mistyurik . |
| 4,556,442 | 12/1985 | Torbeck . |
| 4,561,926 | 12/1985 | Hamisch, Jr. et al. . |
| 4,652,317 | 3/1987 | Seestrom . |
| 4,668,326 | 5/1987 | Mistyurik . |
| 4,956,045 | 9/1990 | Goodwin et al. . |
| 5,107,100 | 4/1992 | Shepard et al. . |
| 5,227,617 | 7/1993 | Christopher et al. . |
| 5,335,170 | 8/1994 | Petteruti et al. . |
| 5,401,352 | 3/1995 | Matsushita et al. . |

FOREIGN PATENT DOCUMENTS

| | | |
|---|---|---|
| 0467014A2 | 1/1992 | European Pat. Off. . |

*Primary Examiner*—Michael W. Ball
*Assistant Examiner*—Sam Chuan Yao
*Attorney, Agent, or Firm*—Joseph J. Grass

[57] ABSTRACT

There is disclosed a hand-held labeler for printing and applying labels and for printing tags. The labeler has a keyboard, a display, a scanner, and a battery-containing handle. The labeler is user-friendly and compact. The labeler can be easily loaded with label and tag webs of different widths. The labeler has a discharge chute for the carrier web which can be slid to a position outside the labeler for easy cleaning.

8 Claims, 8 Drawing Sheets

HAND-HELD LABELER

CROSS-REFERENCE TO RELATED APPLICATION

This is a division of application Ser. No. 08/177,887, filed Jan. 5, 1994, now U.S. Pat. No. 5,486,259, issued Jan. 23, 1996.

BACKGROUND OF THE INVENTION

1. Field of the Invention

This invention relates to the art of printing and applying labels.

2. Brief Description of the Prior Art

The following U.S. Pat. Nos. are made of record: 4,191,608 of Charles B. Bussard et al; 4,199,392 of Paul H. Hamisch, Jr.; 4,264,396 of Donald S. Stewart; 4,544,434 of John D. Mistyurik; 4,556,442 of Daniel J. Torbeck; 4,561,926 of Paul H. Hamisch, Jr. et al, 4,624,733 of Paul H. Hamisch, Jr.; 4,652,317 of Frank E. Seestrom; 4,668,326 of John D. Mistyurik; 4,956,045 of Brent E. Goodwin et al; 5,107,100 of Howard M. Shepard et al; and 5,227,617 of Amy S. Christopher et al.

SUMMARY OF THE INVENTION

The invention relates to an improved labeler for printing and applying labels which is user-friendly by being low cost, has relatively few parts, is easy to assemble, is easy to load and is easy to use.

It is a feature of the invention to provide a labeler which has a housing with a cover or movable housing section, the housing section being movable between a closed or operating position and an open position which facilitates loading of a roll of a composite web of labels on a carrier web. The cover mounts a scanner which can scan data, such as contained in a bar code, and the scanned data can be used to print and apply labels, this being in addition to the keyboard by which data can be entered manually.

It is another feature of the invention to be able to print on webs of labels or tags of different widths, with the web being center-justified so that the longitudinal centerline of the web is on the centerline of the labeler. In accordance with a specific embodiment of the invention, roll mounting members are movable relatively toward and away from each other in unison to different selected positions to mount rolls of different predetermined widths, and the roll mounting members are releasably held in the selected position.

It is another feature of the invention to provide an improved path or guide system for a carrier web in a hand-held labeler. In a specific embodiment, the path for the carrier web includes a chute through which the spent carrier web exits the labeler, and the chute is shiftable to a position outside the labeler housing for cleaning purposes.

It is another feature of the invention to provide a print head assembly for a printer or labeler in which the print head of the assembly is urged into a stop position by a spring or springs within the assembly and by a spring or springs on the outside of the assembly. In a specific embodiment, the labeler has a movable housing section or cover which bears against the spring or springs which are outside of the assembly.

It is another feature of the invention to provide a housing for a labeler, wherein the labeler has a thermal print head and a platen inside the housing in which the housing has a housing section or cover, wherein the cover is movable between closed and open positions, and wherein the cover is used to move the print head to a predetermined stop position, but wherein neither the latch nor the cover has any influence on the predetermined stop position and therefore has no influence on the load or force between the print head and the platen.

It is another feature of the invention to provide a method of cleaning an exit chute of a labeler by sliding the exit chute from an operating position inside the labeler to outside the labeler, cleaning the discharge chute, and returning the exit chute to a position inside the labeler.

DETAILED DESCRIPTION OF A PREFERRED EMBODIMENT OF THE INVENTION

Figure 1:
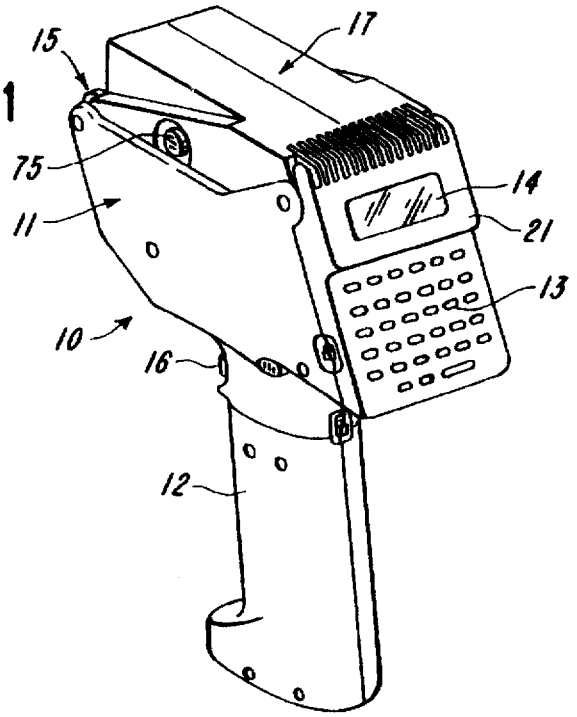
FIG. 1 is a perspective view of the labeler of the invention.

With reference to FIG. 1, there is depicted a hand-held labeler generally indicated at 10 including a housing 11, having a detachable battery containing handle 12, a keyboard 13 and a display 14 at the rear position of the housing 11, an applicator 15 at a front portion of the housing 11 for applying printed labels, and a trigger switch 16 for operating the labeler 10.

Figure 2:
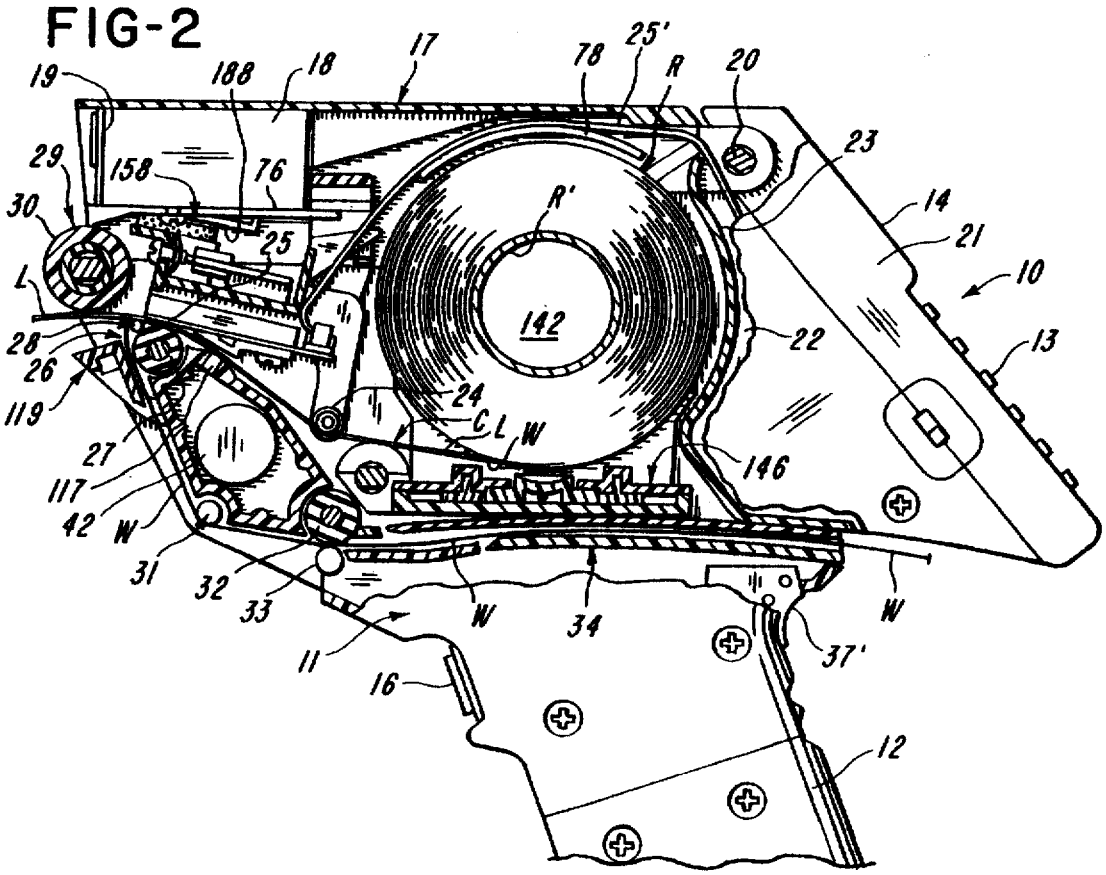
FIG. 2 is a fragmentary sectional elevational view of the labeler.

With reference to FIG. 2, the labeler 10 is shown to have a movable housing section or cover 17 which carries a scanner 18 and a lens 19 mounted at the front end of the scanner 18. The cover 17 is movable between a closed position shown in FIG. 2 and an open position by pivoting the cover 17 about a pivot 20. A movable housing section 21 mounts the keyboard 13 and the display 14 about the pivot 20 so that the housing section 21 can be moved between its closed position shown in FIGS. 1 and 2 and an open position for servicing the electronic components (not shown) housed in a chamber 22 defined in part by a wall 23.

The labeler 10 mounts a roll R of a composite web C of record members illustrated to be a series of labels L releasably adhered to a carrier web W. The roll R is mounted within the housing 11 and the composite web C passes from the roll R into guided relationship with a guide roll 24 and from there to between a print head 25 and a platen 26. The platen 26 is shown to include a platen roll 27. Adjacent the print head 25 is a delaminator 28 about which the carrier web W passes. A label L is delaminated from the carrier web W as the web W is advanced. The label L is advanced following printing into label applying relationship to and under an applicator 29 which is shown to comprise a roll 30. The carrier web W passes from the delaminator 28 into contact with the platen roll 27, about a guide roller 31 into the nip of a feed roll 32 and a back-up roll 33 and through a chute generally indicated at 34 from which the carrier web W exits the housing 11.

Figure 3:
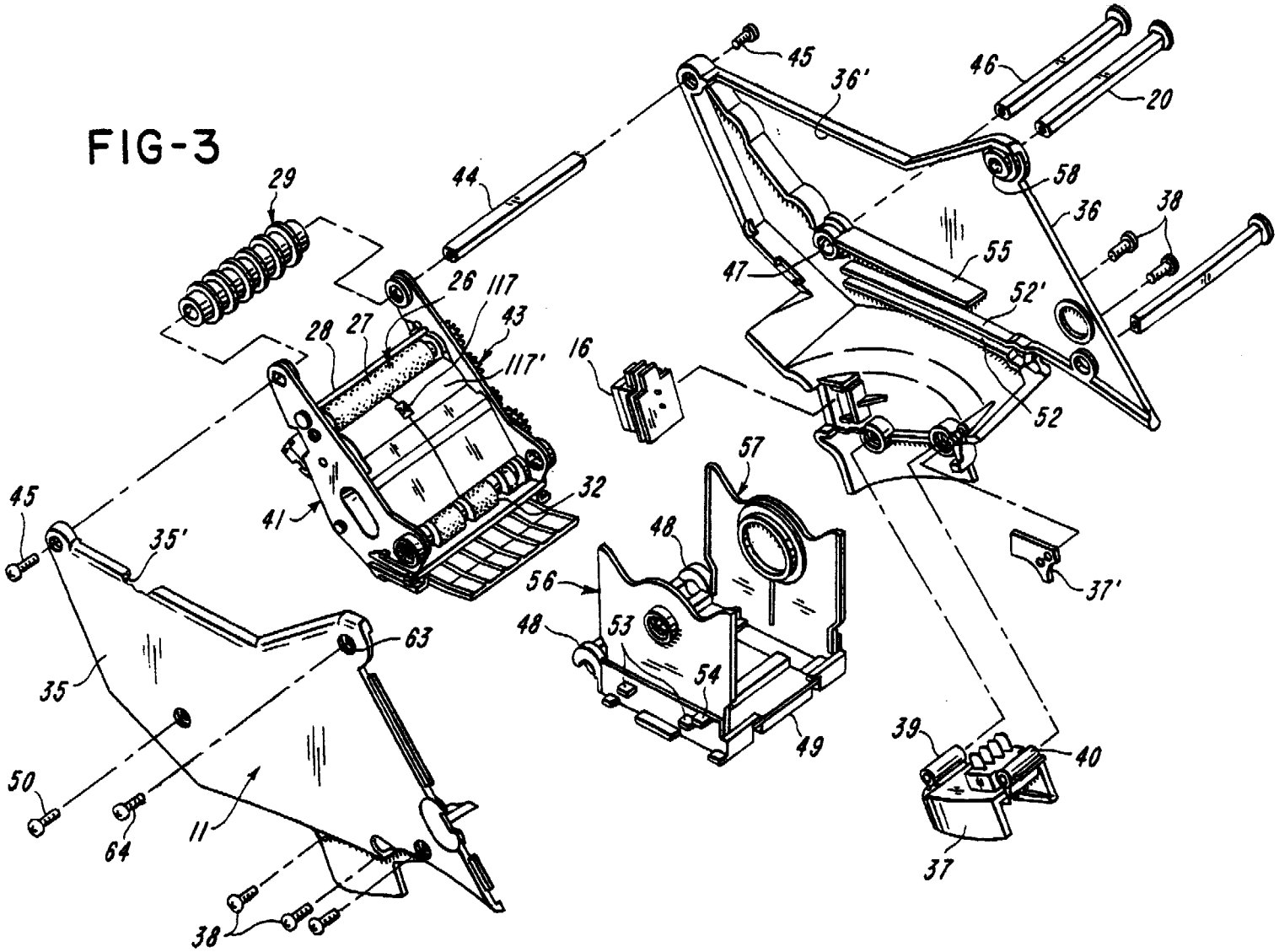
FIG. 3 is a fragmentary exploded perspective view showing various components of the labeler.

With reference to FIG. 3, the housing 11 is shown to include a pair of essentially mirror-image housing sections 35 and 36 connected to the handle 12 by a connector 37. A grounding conductor 37' located adjacent the handle 12 is positioned to contact the user's hand to drain electrostatic charge away from the labeler 10 into the user. Screws 38 extending through housing sections 35 and 36 are threadably received in integrally formed tubular members 39 and 40 which are an integral part of the connector 37. A mounting block or section generally indicated at 41 mounts the platen roll 27, the delaminator 28, the applicator 29, the feed roll 32, the back-up roller 33 (FIGS. 2 and 7), an electric motor and speed reducer 42 (FIG. 7), and gearing 43. The applicator roll 30 is mounted on a pin 44. Screws 45 passing through housing sections 35 and 36 are threadably received in the pin 44. A headed pin 46 passes through a hole 47 in the housing section 36, and through spaced connectors 48 of a base member 49. A screw 50 extends through the housing section 35 and is threadably received in the pin 46. Projections 53 and 54 straddle exposed guides 55 on the housing sections 35 and 36. A retainer 78 keeps a print head flexible connector 25' spaced from the roll R. The base member 49 slidably mounts identical mounting or slide members 56 and 57.

Figure 4:
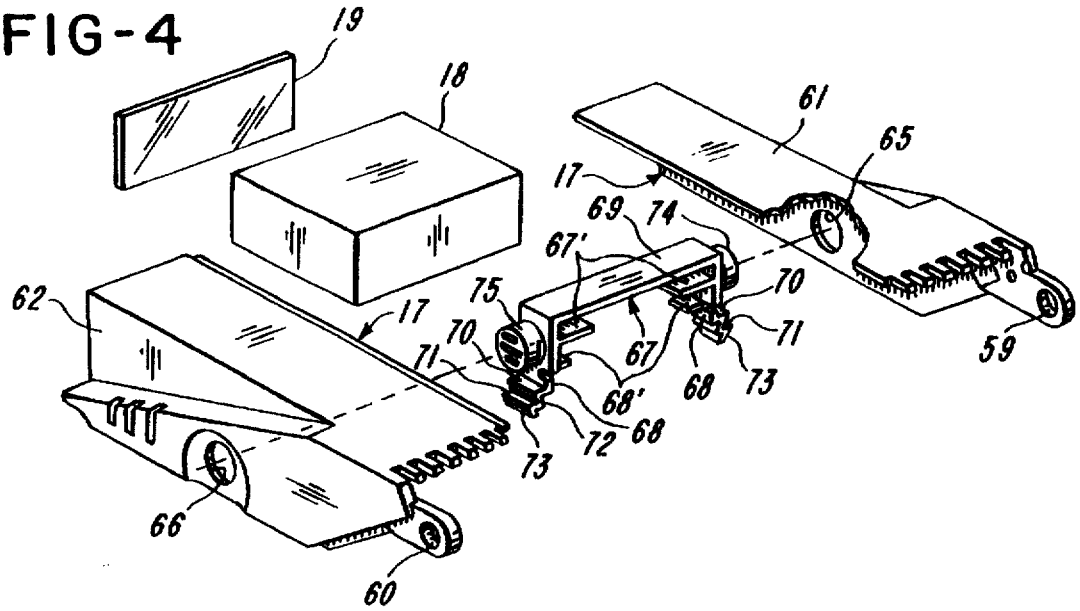
FIG. 4 is a fragmentary exploded view showing latch structure and a scanner which are on a movable housing section of the labeler.
Figure 5:
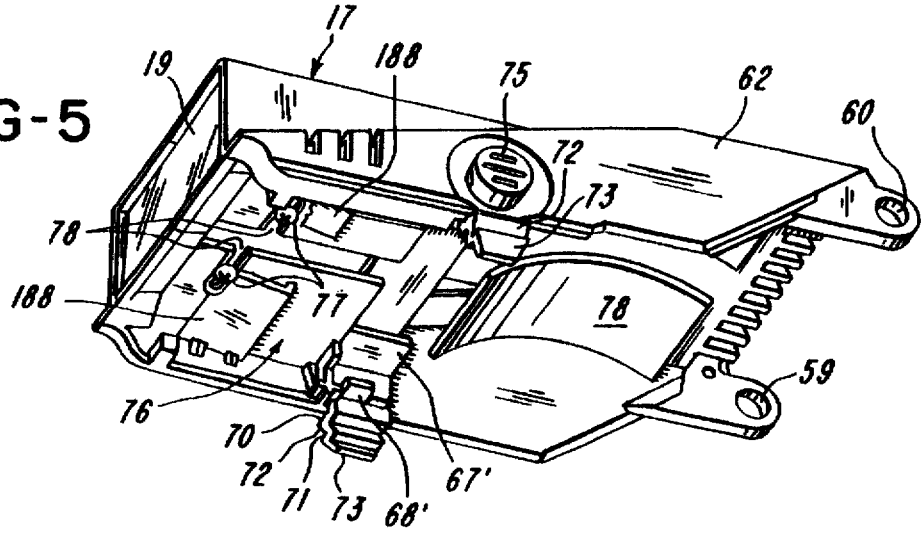
FIG. 5 is a perspective view of the cover.

The pin 20 passes through holes 58 in the housing section 36, through holes 59 and 60 (FIG. 4) in housing parts 61 and 62, and through hole 63 in the housing section 35. The pin 20 also passes through the housing section 21. The housing parts 61 and 62 when connected to form the housing section 17. A screw 64 is threadably received in the pin 20. Housing parts 61 and 62 have respective holes 65 and 66. A latch generally indicated at 67 includes two spring fingers 68 and a connecting member 69. Each spring finger 68 has two latch surfaces 70 and 71 and two cam surfaces 72 and 73. Oppositely extending, manually depressible buttons or projections 74 and 75 extend through respective holes 65 and 66 in respective housing parts 61 and 62. As shown in FIG. 3, the housing sections 35 and 36 have short upper flanges or lips 35' and 36'. Either the two latch surfaces 70 or the two latch surfaces 71 can cooperate with the undersides of the lips 35' and 36' to latch the cover 17 to the remainder of the housing 11. In particular when latching the cover 17, the cover 17 is moved from the open position toward the closed position. The cam surfaces 73 first contact the flanges 35' and 36' and this causes the spring fingers 68 to deflect inwardly toward each other. Thereupon, the latch surfaces 71 become latched under the flanges 35' and 36'. In this position, the print head 25 is spaced slightly from the platen roll 27 so that in the event it is desired to pull the carrier web W through the labeler manually in this position of the cover 17, the user can do so without the drag that would be exerted in the event the print head 25 were in the operating position. On the other hand, if the user further closes the cover 17, the cam surfaces 72 will be cammed by the flanges 35' and 36' and the spring fingers 68 will again be cammed inwardly until the latch surfaces 70 snap into position under the flanges 35' and 36', whereupon the print head 25 is in its operating position as shown in FIG. 2. It will be noted hereinafter that the latch 69 does not determine the stop position of the print head 25 relative to the platen 26.

A transverse member 76 supports the scanner 18. Headed screws 77 pass through slots 78 in the member 76 and are threadably received by the scanner 18.

Figure 6:
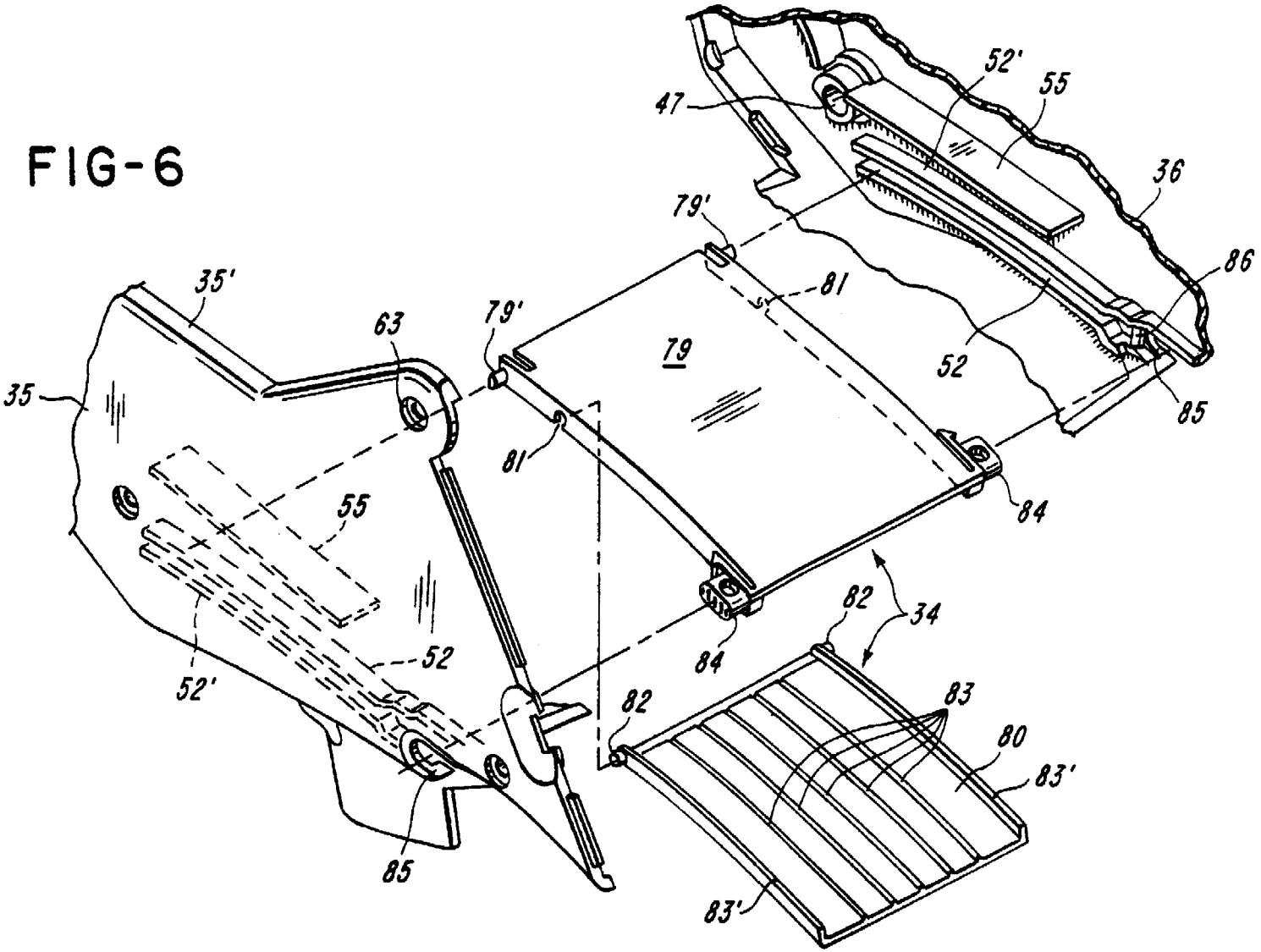
FIG. 6 is a fragmentary exploded perspective view showing an exit chute and its manner of mounting within the housing.

As shown in FIG. 6, each guide 52 and its adjacent guide 52' provide a track for receiving the slidably mounting chute 34. The chute 34 has an upper guide or guide plate 79 and a lower guide or guide plate 80. The guide 79 has a pair of outwardly extending projections 79' received between a track provided by and between the guides 52 and 52'. The upper guide 79 has a pair of C-shaped openings 81 into which projections 82 on the guide 80 are snapped. It is seen that the guide 80 has ridges 83 and side flanges 83' which are higher than the ridges. The carrier web W can pass between the guides 79 and 80 and the ridges 83 minimize contact between the carrier W and guide 80. The chute 34 is held in position by oppositely extending projections 84 which snap into recesses 85 in the housing sections 35 and 36. When it is desired to clean the chute 34, e.g. to remove labels or the carrier web adhered therein, or to remove adhesive build-up, or the like, the projections 84 are manually grasped by the user with his/her thumb and index finger and the chute 34 is pulled out of the housing 11 to a stop position determined by opposed stops 86 (only one of which is shown). When the chute 34 has been slid out of the housing 11, the guide 80 is free to pivot downwardly about projections 82 so that the underside of the guide 79 and the upper side of the guide 80 are open by a wide angle to facilitate cleaning thereof. Thereafter the guide 80 can be pivoted back to its original position, generally parallel to the guide 79, and the chute 34 can be slid back into the housing to the position shown in FIG. 2.

Figure 7:
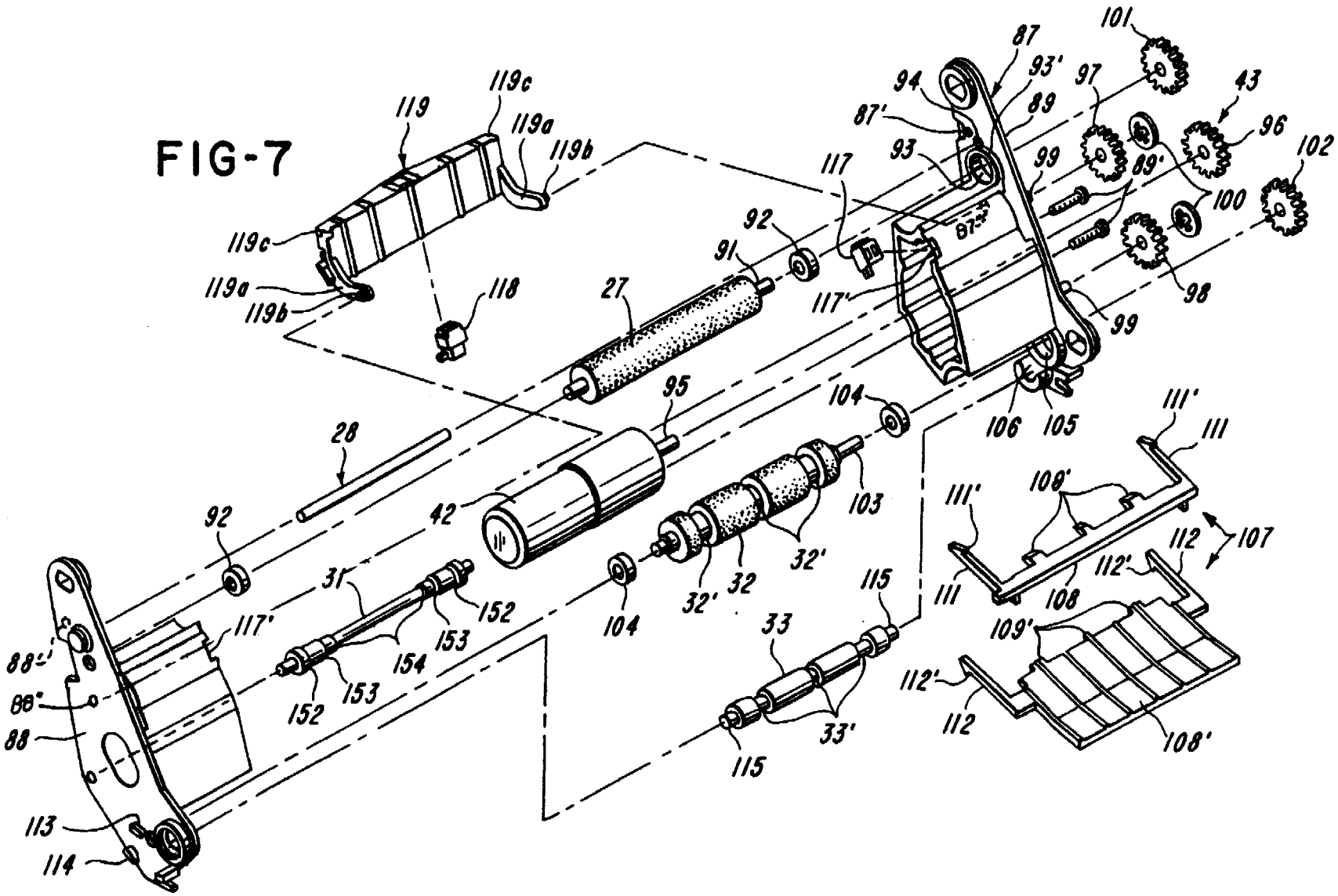
FIG. 7 is an exploded perspective view showing, among other things, structure for advancing the carrier web.

With reference to FIG. 7, there is shown a subframe or mounting section generally indicated at 87 which includes left and right aligned mirror-image subframe portions 88 and 89. The platen roll 27 is shown to be mounted on and secured to a shaft 91. The shaft 91 is mounted on bearings 92 received in opposed recesses 93 (only one of which is shown) in the subframe portions 88 and 89. The delaminator 28 is mounted in aligned holes 94 (only one of which is shown) in the subframe portions 88 and 89. The subframe portions 88 and 89 are hollow and the motor and speed reducer 42 are secured to the subframe portion 89 by screws 89'. The output shaft 95 is secured to a gear 96 which meshes with and drives idler gears 97 and 98. The gears 97 and 98 are rotatably mounted on posts 99 and are retained thereon by retainers 100. The gear 97 meshes with a gear 101 secured to the shaft 91. The gear 98 meshes with a gear 102 which is secured to a shaft 103 of the feed roll 32. The shaft 103 is mounted in bearings 104 received in opposed recesses 105 (only one of which is shown) in the respective subframe portions 88 and 89. End portions 115 of the back-up roller 33 are received in spaced cradles 106. The cradles 106 are positioned so that the carrier web W which passes between the roll 32 and the roller 33 is advanced. There is no speed reduction or speed increase due to the gearings 43 because all the gears 96, 97, 98, 101 and 102 are identical in pitch and number of teeth. However, the outside diameter of the feed roll 32 is Just slightly greater than the outside diameter of the platen roll 27. Thus, the gearing 43 causes the peripheral speed of the feed roll 32 to be slightly greater than the peripheral speed of the platen roll 27. Thus there is a slight amount of slippage between the feed roll 32 and the carrier web W. The contact force between the platen roll 27 and the carrier web W is greater than the contact force between the grooved feed roll 32 and the back-up roller 34, so that the slippage is designed to occur at the feed roll 32 instead of at the platen roll 27. Both the platen roll 27 and the feed roll 32 are composed of the same resilient material, namely, urethane. As the carrier web W passes beyond the nip of the feed roll 32 and the back-up roller 33, the carrier web W is confined to move into the chute 34 by a stripper and guide device generally indicated at 107. The device 107 includes a U-shaped upper guide 108 with stripper fingers 108' and a lower guide 109 with stripper fingers 109'. The stripper fingers 108' cooperate with grooves 32' in the feed roll 32 and the stripper fingers 109' cooperate with grooves 33' in the back-up roller 33. The device 107 is clipped to the subframe 87 by superimposed arms 111 and 112 with hooked ends 111' and 112'. The arms 111 and 112 fit between projections 113 and 114 and end 111' and 112' hook onto respective projections 113 and 114.

As shown, ends 115 of the roll 33 are mounted in the cradles 106 (only one of which is shown).

Also shown in FIG. 7 is a sensor 117 received in complementary notches 117' for sensing the carrier web for registration purposes. The sensor 117 is on a guide surface 117' which projects into the path between the roller 24 and the platen roll 27 so that the web W which has sense marks on its underside bears against the surface 117' at a fixed distance away from the sensor 117. Another sensor 118 received in a label support 119 senses the absence or presence of a label at the label applying position, that is, when a label L is in underlying position with respect to the applicator roll 30.

The label support 119 has arms **119*a*. Pivot pins 119*b* on arms 119*a* are received in holes 87" and 88" to enable the label support 119 to be pivoted counterclockwise (FIG. 2) away from the platen roll 27. The label support 119 has detents 119*c* which can snap into recesses 87' and 88' in members 87 and 88 to releasably hold the label support 119** in its operating position.

Figures 8, 9:
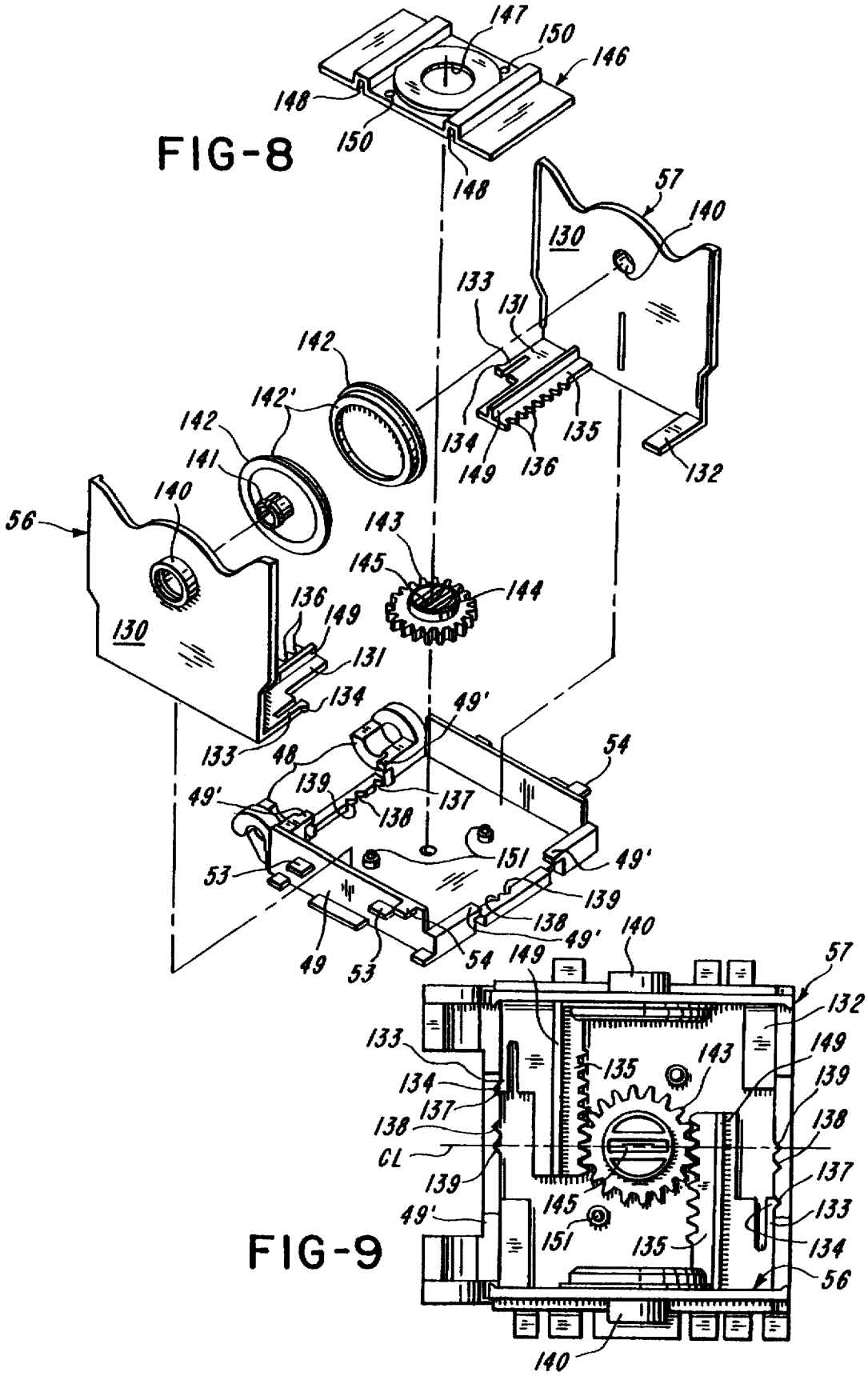
FIG. 8 is an exploded perspective view showing a device for accommodating label rolls of different widths.
FIG. 9 is an assembled fragmentary top plan view of the device depicted in FIG. 8.

With reference to FIGS. 8 and 9, the roll mounting members 56 and 57 are identical and have upright portions 130 and projections 131 and 132 extending perpendicular thereto. The projection 131 includes a flexible resilient finger 133 having a detent 134 and a rack 135 with gear teeth 136. The projections 131 and 132 help to slidably mount the mounting members 56 and 57 on the base member 49. The detents 134 selectively cooperate with notches or recesses 137, 138 or 139. In the position shown in FIG. 9, the spring fingers 133 cooperate with the recesses 137. The upright portions 130 have tubular members 140 into which studs 141 of identical hubs or rolls 142 are snapped. The rolls 142 have annular portions or hubs 142' which fit into the annular hole or core R' on the inside of the roll R. A gear 143 has a central projection 144 with a coin slot 145. The gear 143 meshes with the racks 135. A retainer 146 is received over the racks 135 and the gear 143. The retainer 146 has a central hole 47 which receives the projection 144 and keeps the gear 143 centered. The retainer 146 has channels 148 which receive and guide the flanges 149 on the projections 131. The retainer 146 has a pair of holes 150 which receive studs 151. When assembled, the upper ends of the studs 151 extend into holes 150 and precisely locate the retainer 146. By inserting a coin or a screw driver (not shown) in the slot 145, the gear 143 can be rotated counterclockwise (FIG. 9) to cause members 56 and 57 to move toward each other in unison and to cause the detents 134 to move out of the recesses 137 and into the recesses 138. Even further rotation of gear 143 would cause the detents 134 to enter the recesses 139. It is apparent that when the detents 134 are in the recesses 137, the mounting members 56 and 57 will accept the widest roll R. When the detents 134 are in the recesses 139, the mounting members will mount the narrowest roll R. When the detents 134 are in the recesses 138, the mounting members 56 and 57 will mount a roll R which is wider than the narrowest roll and narrower than the widest roll. By the disclosed arrangement, the mounting members 56 and 57 move toward or away from each other in unison upon rotation of the gear 143, and the mounting member 56 and 57 move equal distances from a centerline CL, which is also the longitudinal centerline of the labeler and in particular the centerline of the print head 25 and guide rollers 24 and 31.

It is seen that the guide roller 31 is stepped to provide pairs of annular guide edges 152, 153 and 154. Likewise the guide roller 24 (FIG. 10) has pairs of annular guide edges 155, 156 and 157. The pairs of guide edges 152 and 155 correspond to a wide carrier web W of a wide roll R as would be mounted on the mounting members 56 and 57 in the position illustrated in FIG. 9. The pairs of guide edges 154 and 157 correspond to a narrow carrier web W of a narrow roll R as would be mounted on the mounting members 56 and 57 in the position in which detents 134 cooperate with recesses 139. The pairs of guide edges 153 and 156 correspond to a carrier web W narrower than the wide carrier web W of a wide roll R and wider than the narrow carrier web W of a narrow roll R. The guide edges 153 and 156, therefore, correspond to the position in which the detents 134 cooperate with recesses 138.

Figure 10:
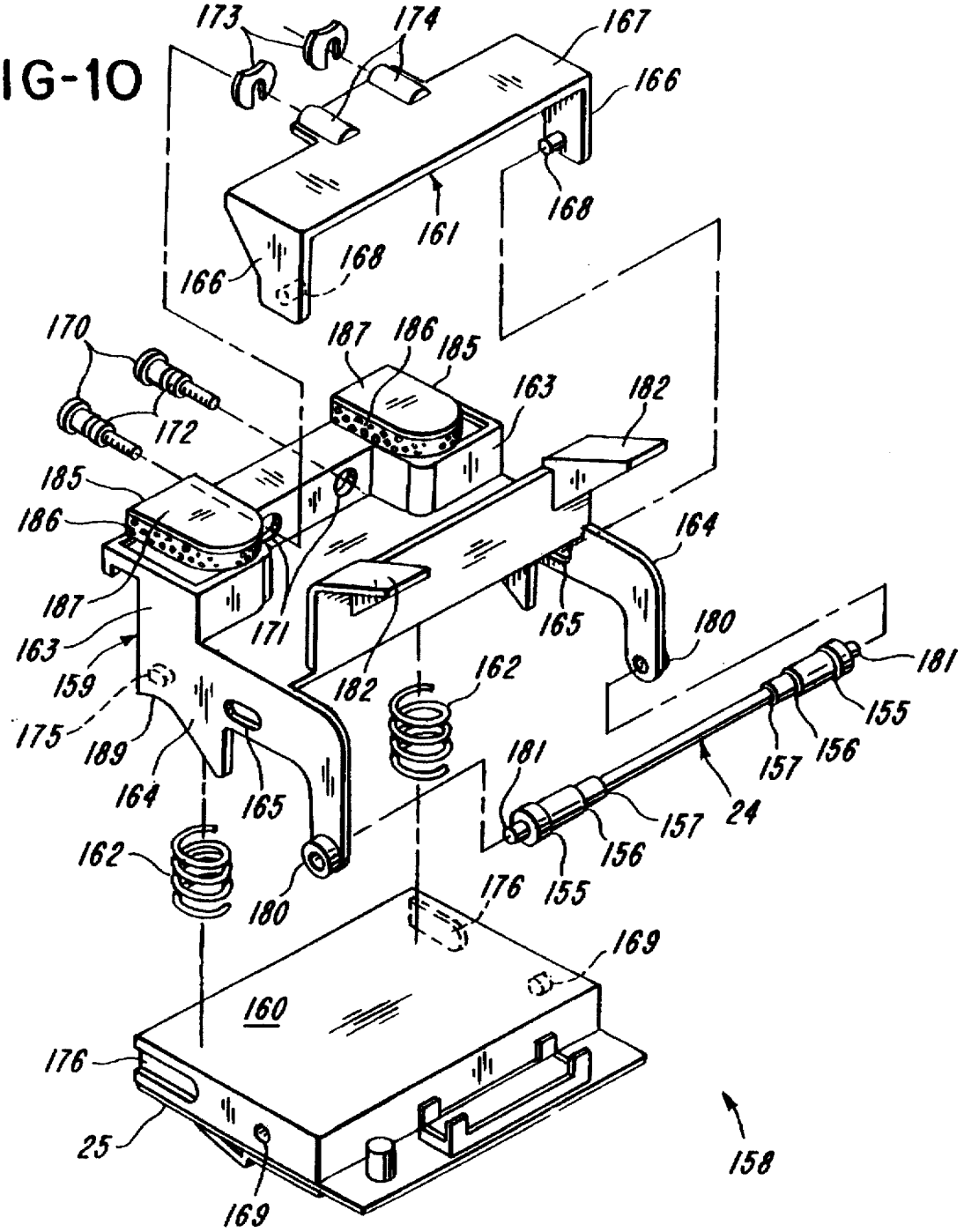
FIG. 10 is an exploded perspective view of the print head assembly.

With reference to FIG. 10, there is shown a print head assembly generally indicated at 158 which includes a mounting member 159, a heat sink 160 to the underside of which the print head 25 is secured, an adjusting device 161, and compression springs 162.

The springs 162 bear against the inside of inverted cup-shaped portions 163 of the mounting member 159 and against the upper surface of the heat sink 160. Thus, the springs 162 urge the mounting member 159, and the heat sink 160 and its print head 25, relatively apart. The mounting member 159 has a pair of depending arm portions 164 having laterally aligned generally horizontal elongate slots 165. The adjusting device 161 is generally inverted U-shaped with a pair of depending arms 166 and a bridge or connector 167. The arms 166 have opposed pivots 168 which pass through slots 165 and are received in aligned holes 169 with a minimum of clearance. It is apparent that the position of the adjusting device controls the position of the heat sink 160 and the print head 25.

The mounting member 159 is stationary against rotation in the horizontal plane, however, the adjusting device 161 can cause the heat sink 160 and the print head 25 to rotate in the horizontal plane to bring the straight line of printing elements of the print head 25 into alignment with the axis of the platen roll 27. The adjusting device 161 includes adjusting screws 170 which pass through oversize holes 171 in the mounting member 159. The screws 170 have annular grooves 172 which receive spring clips 173. The screws 170 are free to rotate in the holes 171 and in the spring clips 173. The spring clips 173 grip portion 170' so that the clips 173 do not rotate. The screws 170 are threadably received in threaded metal inserts (not shown) in tubular members 174 which are an integral part of the bridge 167. Selective rotation of the screws 170 causes the heat sink 160 and the print head 25 to rotate in essentially the horizontal plane (FIG. 2).

The arms 164 have opposed projections 175 received in overly wide elongate slots 176 in the heat sink 160. This helps hold the mounting member 159 and the heat sink 160 in assembled relationship. The arms 164 have holes 180 which receive and rotatably mount end portions 181 of the roller 24.

The mounting member 159 also has rearwardly and upwardly extending projections 182 which are straddled by respective pairs of projections 67' and 68' on the latch 67 to hold the mounting member 159 in assembled relationship on the cover 17.

Figure 11:
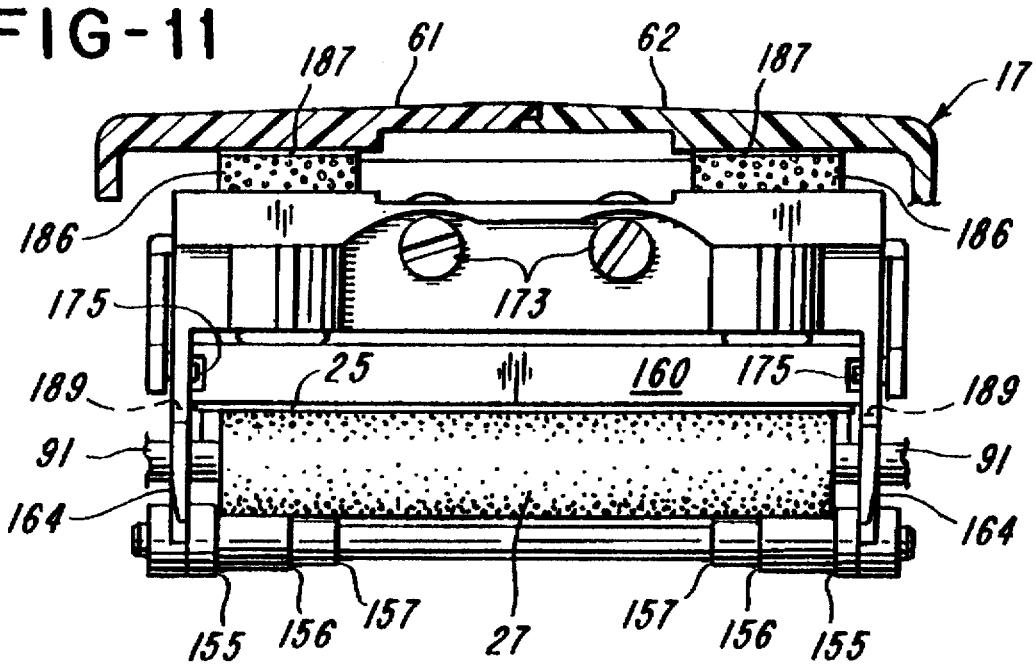
FIG. 11 is a front elevational view, partly in section, of the print head assembly and the platen roll with which the print head cooperates.
Figure 12:
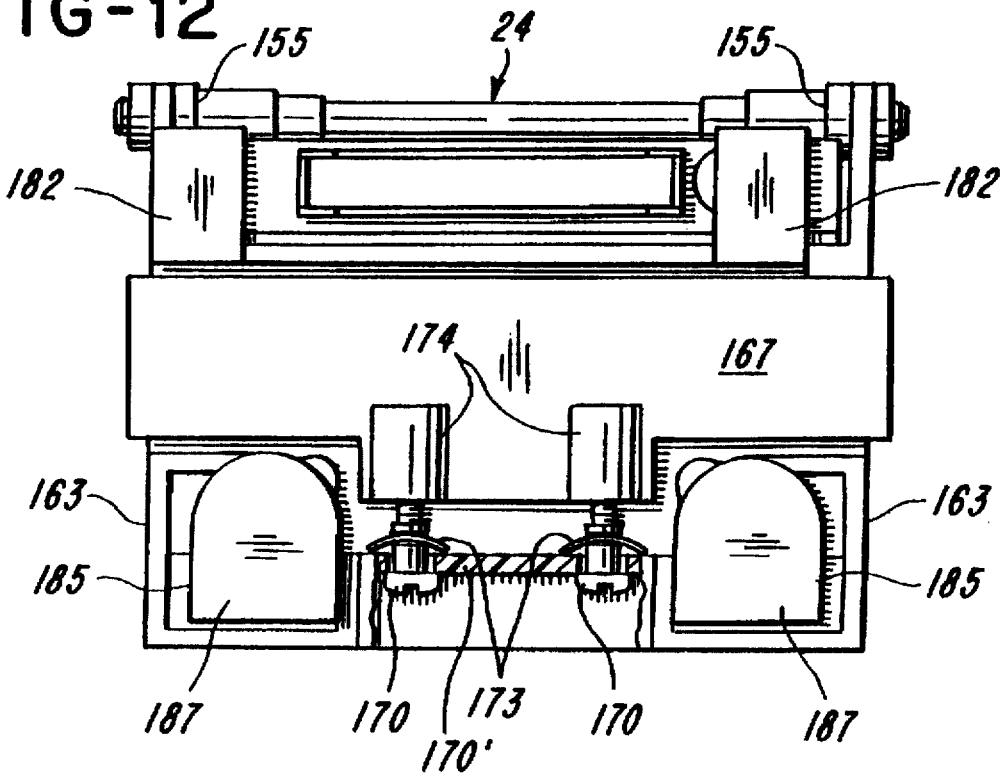
FIG. 12 is a top plan view of the print head assembly shown in FIG. 11.

There are two springs 185 adhesively mounted on the cup-shaped portions 163. The springs 185 are comprised of a foam rubber type of material 186 but which have a slick cover 187 which aids in assembly. The springs 185 bear against inclined surfaces 188 on the cover 17. As shown in FIG. 2, when the cover 17 is in its operating position, the springs 185 are compressed and urge the print head assembly 158 toward the platen 26. However, the mounting member 159 has two identical stop surfaces 189 (FIGS. 10 and 11) on each arm 164 which bear against the tubular members 93' (FIG. 7) beyond the ends of the platen roll 27, to define the amount of pressure between the print head 25 and the platen roll 27. Accordingly, it is seen that irrespective of the forces exerted by the springs 185, the pressure of the print head 25 against the platen roll 27 is controlled solely by the springs 162.

Although a composite label web C is illustrated, the labeler 10 can print on a web of tags because the platen roll 27 is a driven roll.

The labeler 10 is comprised essentially entirely of molded plastics material and is lightweight in construction.

Other embodiments and modifications of this invention will suggest themselves to those skilled in the art, and all such of these as come within its scope as best defined by the appended claims.

We claim:

1. A hand-held labeler comprising: a housing having a front portion, a rear portion, an upper portion and, a generally downwardly extending handle, the housing having a space for receiving a label roll composed of a composite label web having a series of labels releasably adhered to a carrier web, a motor-driven platen roll, a print head cooperable with the platen roll and the composite label web for printing on labels, a delaminator for delaminating printed labels from the carrier web, the housing having an exit opening disposed above the handle for enabling the spent carrier web to exit rearwardly of the handle, an applicator at the front portion of the housing for applying printed labels, a scanner mounted at the upper portion of the housing for scanning bar coded data, a keyboard at the rear portion of the housing for entering data, wherein the space for receiving the label roll is between the keyboard and the applicator, and wherein the space for receiving the label roll is between the scanner and the handle.

2. A hand-held labeler, comprising: a housing having a front portion, a rear portion, an upper portion and a generally downwardly extending handle, the housing having a space for receiving a label roll composed of a composite label web having a series of labels releasably adhered to a carrier web, means for mounting the label roll in the space, a motor-driven platen roll, a print head cooperable with the platen roll and the composite label web for printing on labels, a delaminator for delaminating printed labels from the carrier web, the housing having an exit opening disposed above the handle for enabling the spent carrier web to exit rearwardly of the handle, an applicator at the front portion of the housing for applying printed labels, a scanner mounted at the upper portion of the housing for scanning bar coded data, a keyboard at the rear portion of the housing for entering data, wherein the space for receiving the label roll is between the keyboard and the applicator, and wherein the space for receiving the label roll is between the scanner and the handle.

3. A hand-held labeler, comprising: a housing having a front portion, a rear portion, an upper portion and a generally downwardly extending handle, the housing having a space for receiving a label roll composed of a composite label web having a series of labels releasably adhered to a carrier web, means for mounting label rolls of different widths in the space, a motor-driven platen roll, a print head cooperable with the platen roll and the composite label web for printing on labels, a delaminator for delaminating printed labels from the carrier web, the housing having an exit opening disposed above the handle for enabling the spent carrier web to exit rearwardly of the handle, an applicator at the front portion of the housing for applying printed labels, a scanner mounted at the upper portion of the housing for scanning bar coded data, a keyboard at the rear portion of the housing for entering data, wherein the space for receiving the label roll is between the keyboard and the applicator, and wherein the space for receiving the label roll is between the scanner and the handle.

4. A hand-held labeler, comprising: a housing having a front portion, a rear portion, an upper portion and a generally downwardly extending handle, the housing having a space for receiving a label roll composed of a composite label web having a series of labels releasably adhered to a carrier web, a motor-driven platen roll, a print head cooperable with the platen roll and the composite label web for printing on labels, a delaminator for delaminating printed labels from the carrier web, the housing having an exit opening disposed above the handle for enabling the spent carrier web to exit rearwardly of the handle, an applicator at the front portion of the housing for applying printed labels, a scanner mounted at the upper portion of the housing for scanning bar coded data, wherein the scanner is disposed above the level of the print head, a keyboard at the rear portion of the housing for entering data, wherein the space for receiving the label roll is between the keyboard and the applicator, and wherein the space for receiving the label roll is between the scanner and the handle.

5. A hand-held labeler, comprising: a housing having a front portion, a rear portion, an upper portion and a generally downwardly extending handle, the housing having a space for receiving a label roll composed of a composite label web having a series of labels releasably adhered to a carrier web, a motor-driven platen roll, a print head cooperable with the platen roll and the composite label web for printing on labels, a delaminator for delaminating printed labels from the carrier web, the housing having an exit opening disposed above the handle for enabling the spent carrier web to exit rearwardly of the handle, an applicator at the front portion of the housing for applying printed labels, a scanner mounted at the upper portion of the housing for scanning bar coded data, wherein the housing further includes a moorable housing section mounting the scanner, a keyboard at the rear portion of the housing for entering data, wherein the space for receiving the label roll is between the keyboard and the applicator, and wherein the space for receiving the label roll is between the scanner and the handle.

6. A hand-held labeler, comprising: a housing having a front portion, a rear portion, an upper portion and a generally downwardly extending handle, the housing having a space for receiving a label roll composed of a composite label web having a series of labels releasably adhered to a carrier web, a motor-driven platen roll, a print head cooperable with the platen roll and the composite label web for printing on labels, a delaminator for delaminating printed labels from the carrier web, the housing having an exit opening disposed above the handle for enabling the spent carrier web to exit rearwardly of the handle, an applicator at the front portion of the housing for applying printed labels, a scanner mounted at the upper portion of the housing for scanning bar coded data, wherein the housing further includes a movable housing section for mounting the scanner, wherein the movable housing section is releasably latchable to the remainder of the housing, a keyboard at the rear portion of the housing for entering data, wherein the space for receiving the label roll is between the keyboard and the applicator, and wherein the space for receiving the label roll is between the scanner and the handle.

7. A hand-held labeler, comprising: a housing having a front portion, a rear portion, an upper portion and a generally downwardly extending handle, the housing having a space for receiving a label roll composed of a composite label web having a series of labels releasably adhered to a carrier web, a motor-driven platen roll, a print head cooperable with the platen roll and the composite label web for printing on labels, a delaminator for delaminating printed labels from the carrier web, the housing having an exit opening disposed above the handle for enabling the spent carrier web to exit rearwardly of the handle, a movably mounted chute terminating at the exit opening, an applicator at the front portion of the housing for applying printed labels, a scanner mounted at the upper portion of the housing for scanning bar coded data, a keyboard at the rear portion of the housing for entering data, wherein the space for receiving the label roll is between the keyboard and the applicator, and wherein the space for receiving the label roll is between the scanner and the handle.

8. A hand-held labeler, comprising: a housing having a front portion, a rear portion, an upper portion and a generally downwardly extending handle, the housing having a space for receiving a label roll composed of a composite label web having a series of labels releasably adhered to a carrier web, a motor-driven platen roll, a motor, gearing coupling the motor to the platen roll, a print head cooperable with the platen roll and the composite label web for printing on labels, a delaminator for delaminating printed labels from the carrier web, the housing having an exit opening disposed above the handle for enabling the spent carrier web to exit rearwardly of the handle, an applicator at the front portion of the housing for applying printed labels, a scanner mounted at the upper portion of the housing for scanning bar coded data, a keyboard at the rear portion of the housing for entering data, wherein the space for receiving the label roll is between the keyboard and the applicator, and wherein the space for receiving the label roll is between the scanner and the handle.

* * * * *